US006146172A

United States Patent [19]

Wu et al.

[11] Patent Number: 6,146,172

[45] Date of Patent: Nov. 14, 2000

[54] ELECTRICAL CONNECTOR

[75] Inventors: Ming-Chuan Wu, Shun-Lin; Da-Ching Lee, Tu-Chen, both of Taiwan

[73] Assignee: Hon Hai Precision Ind. Co., Ltd., Taipei Hsien, Taiwan

[21] Appl. No.: 09/375,242

[22] Filed: Aug. 16, 1999

[30] Foreign Application Priority Data

Jun. 8, 1999 [TW] Taiwan ..... 88209349

[51] Int. Cl.[7] ..... H01R 12/26

[52] U.S. Cl. ..... 439/260; 439/498

[58] Field of Search ..... 439/67, 77, 492, 439/495, 499, 329, 260, 498

[56] References Cited

U.S. PATENT DOCUMENTS

| | | | |
|---|---|---|---|
| 4,959,030 | 9/1990 | Tatebe et al. | 439/498 |
| 4,973,264 | 11/1990 | Kamono et al. | 439/498 |
| 5,501,610 | 3/1996 | Ikemoto | 439/498 |
| 5,695,360 | 12/1997 | Seto et al. | 439/260 |
| 5,738,545 | 4/1998 | Igarashi et al. | 439/492 |
| 5,842,883 | 12/1998 | Igarashi et al. | 439/260 |

*Primary Examiner*—Gary F. Paumen
*Attorney, Agent, or Firm*—Wei Te Chung

[57] ABSTRACT

An electrical connector comprises an elongate insulative housing, a plurality of terminals retained in the housing and a stuffer. A pair of retention holes is formed in each end of the stuffer corresponding to ribs formed on opposite ends of the housing. Each terminal includes a mating end, a first mating tail and a second mating tail. A first gap is defined between the first mating tails of the terminals and the stuffer for receiving an end of a first flexible cable with the first mating tails contacting the first flexible cable. A second gap is defined between the second mating tails of the terminals and the stuffer for receiving an end of a second flexible cable with the second mating tails contacting the second flexible cable.

1 Claim, 7 Drawing Sheets

ELECTRICAL CONNECTOR

BACKGROUND OF THE INVENTION

The present invention relates to an electrical connector, and especially to an electrical connector for connecting with a pair of flexible cables extending in opposite directions.

When a pair of devices to be connected is individually assembled in a computer enclosure and is required to be easily replaced by an alternative component, a permanent connection method such as soldering connection is unfavorable. A flexible cable made of an FPC (Flexible Printed Circuit) or an FFC (Flexible Flat Cable) for providing releasable electrical connection between the devices is one the solution to the above problem. The flexible cable is especially useful within a narrow space of a computer enclosure having an abnormal dimension due to the high flexibility thereof.

A conventional connector such as the one disclosed in U.S. Pat. No. 5,738,545 is connected to a flexible cable inserted therein by pressing against the flexible cable to contact a plurality of terminals of the electrical connector. Therefore, the flexible cable is secured within the connector. However, the electrical connector only has one receiving opening for receiving the flexible cable in a predetermined direction. When the flexible cable is required to be connected to the electrical connector from a direction opposite the predetermined direction, the flexible cable must be bent. Thus, the flexible cable and conductive wires therein are likely to be damaged.

Furthermore, a second similar electrical connector should be adopted if two or more flexible cables are required. Consequently, circuits on a PCB (Printed Circuit Board) must be rearranged thereby adversely affecting an efficient circuit layout on the PCB. Since the added circuits and components increase manufacturing costs, an electrical connector can receives a pair of flexible cables in opposite directions is desired.

SUMMARY OF THE INVENTION

Accordingly, the primary object of the present invention is to provide an electrical connector which receives a pair of flexible cables in opposite directions.

Another object of the present invention is to provide an electrical connector for connection with a flexible cable which facilitates long distance transmission.

To fulfill the above-mentioned objects, an electrical connector for connection with a flexible cable comprises an elongate insulative housing, a plurality of terminals retained in the housing and a stuffer. The housing defines a plurality of passageways between a mating surface and a mounting surface thereof for receiving the terminals. A pair of retention holes is formed in each end of the stuffer corresponding to ribs formed on opposite ends of the housing. Each terminal includes a mating end, a first mating tail and a second mating tail. The stuffer is mounted to the housing with the ribs engaging with the holes. A first gap is defined between the first mating tails of the terminals and the stuffer for receiving an end of the flexible cable with the first mating tails contacting corresponding circuit tracks thereof. The stuffer is further downwardly pushed to press against the flexible cable to engage with the mounting portions and secure the end of the flexible cable within the housing. A second gap is defined between the second mating tails and the stuffer opposite the first gap. Thus, the flexible cable can be received in the second gap and connected to the second mating tails by being pressed by the stuffer.

Other objects, advantages and novel features of the invention will become more apparent from the following detailed description when taken in conjunction with the accompanying drawings.

DETAILED DESCRIPTION OF A PREFERRED EMBODIMENT

Figure 1:
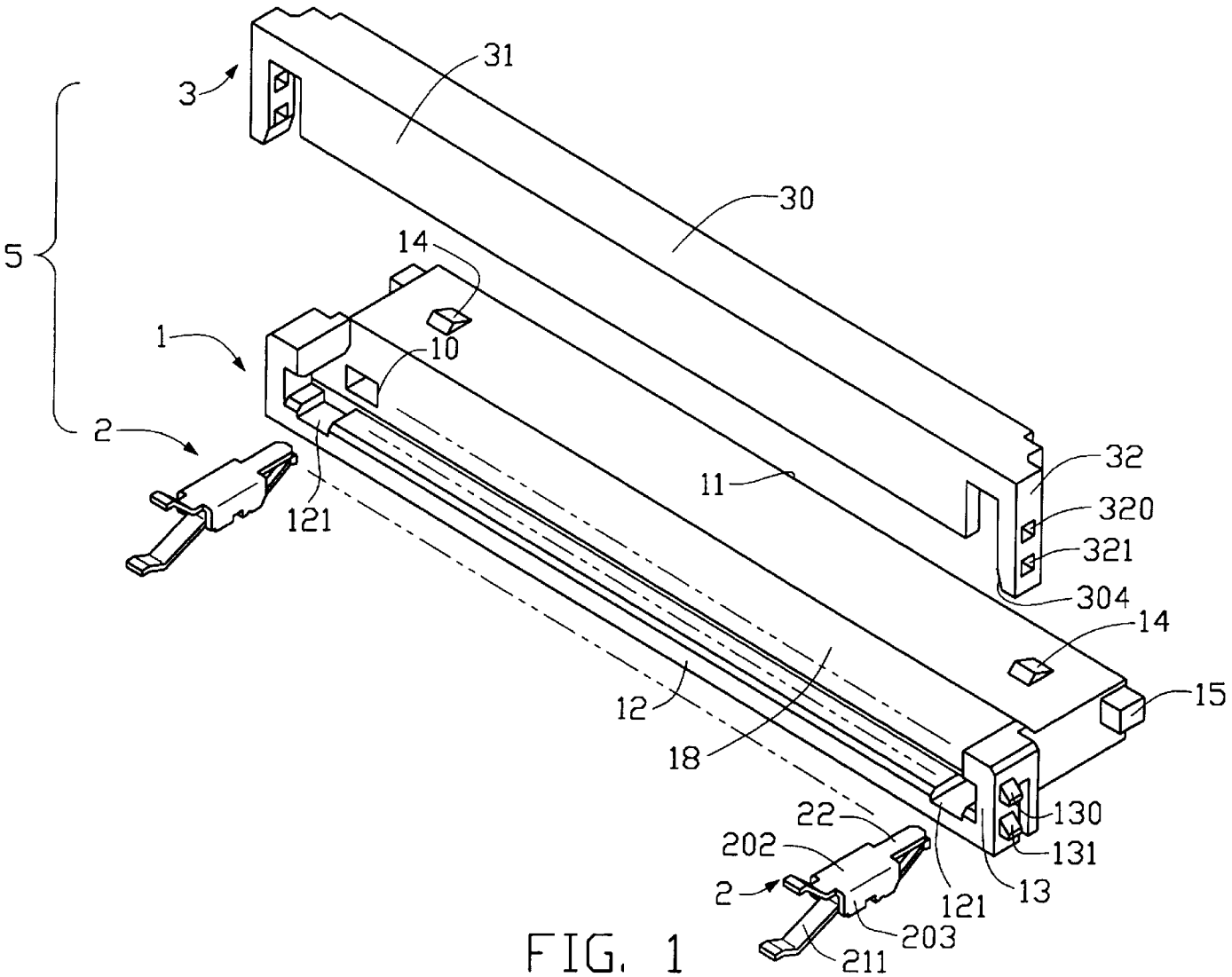
FIG. 1 is an exploded view of an electrical connector in accordance with the present invention.

Referring to FIG. 1, an electrical connector 5 in accordance with the present invention comprises an elongate housing 1, a plurality of terminals 2 and an insulative stuffer 3.

The housing 1 defines a plurality of passageways 10 between a mating surface 11 and a mounting surface 18 thereof. A pair of retention device 13 is disposed on opposite ends of the housing 1 and rearwardly extends therefrom. A first rib 130 and a second rib 131 are formed on an outer surface of each retention device 13. The first rib 130 and the second rib 131 are vertically aligned and each rib 130, 131 forms an inclined outer surface. A pair of projections 14 is formed on a top surface of the housing 1 and each projection 14 forms defines inclined surface. A pair of blocks 15 outwardly projects from opposite lateral ends of the housing 1 for orienting purposes when the electrical connector 5 mates with a second connector (not shown).

The stuffer 3 includes an elongate body 30, a stop wall 31, and a pair of resilient arms 32 extending from opposite ends of the body 30 and distanced from the stop wall 31. The distance between opposite inner surfaces of the arms 32 is substantially equal to the distance between opposite outer surfaces of the retention device 13. Each arm 32 defines a first hole 320 and a second hole 321. The first hole 320 and the second hole 321 are vertically aligned corresponding to the first rib 130 and the second rib 131 of the housing 1. An inclined surface 304 is formed on the arm 32 proximate a distal end thereof for facilitating engagement between the ribs 130, 131 and the holes 320, 321. An elongate supporting plate 12 rearwardly extending from the housing 1 proximate a bottom surface of the housing 1 defines a plurality of recesses 121 in a top surface thereof corresponding to the passageways 10.

Figure 2:
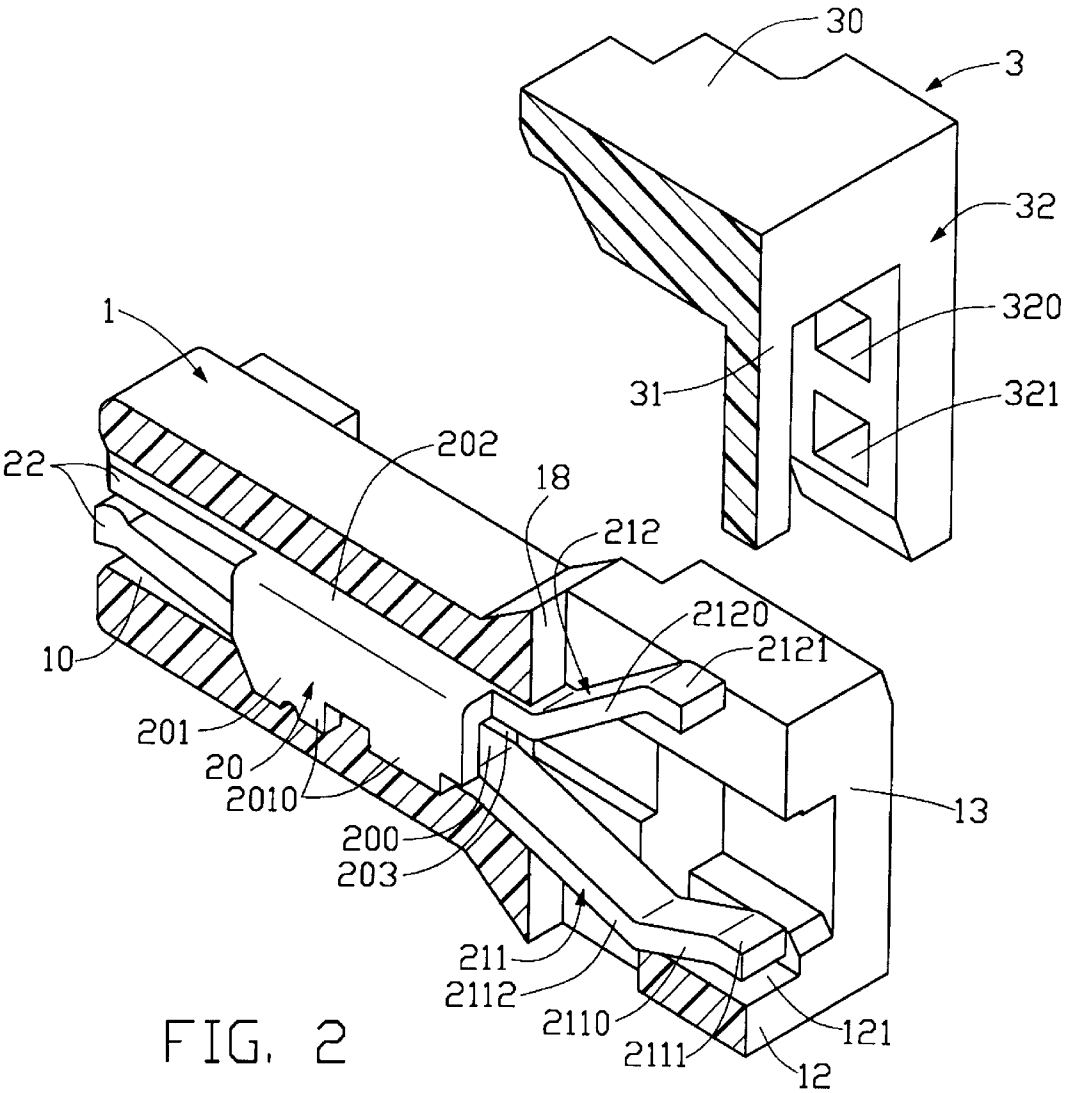
FIG. 2 is a partial cross-sectional view of the electrical connector of the present invention before a stuffer is assembled thereto.

Also referring to FIG. 2, each terminal 2 is unitarily stamped and formed to include a central barrel portion 20 having a bottom wall 200, a first side wall 203 extending from an edge of the bottom wall 200, a top wall 202 extending from an edge of the first side wall 203, and a second side wall 201 extending from an edge of the top wall 202. The bottom wall 200 and the second side wall 201 define a seam (not shown) therebetween. The first side wall 203 is substantially parallel to the second side wall 201, and the top wall 202 is substantially parallel to the bottom wall 200. The first and second walls 203, 201 are perpendicular to the top and bottom walls 202, 200. A pair of mating ends 22 extends from front edges of the top wall 202 and the bottom wall 200. A first mating tail 212 and a second mating tail 211 extend from rear edges of the top wall 202 and the bottom wall 200. The first mating tail 212 includes an intermediate portion 2120 upwardly extending at an incline and a contact portion 2121 horizontally extending from a distal end of the intermediate portion 212. The second mating tail 211 includes an intermediate portion 2112 downwardly extending at an incline, an interim portion 2110 upwardly extending from a distal end of the intermediate portion 2112, and a contact portion 2111 horizontally extending from a distal end of the interim portion 2110. The second side wall 201 forms locking barbs 2010 along an edge thereof for being interferentially fit in the passageways 10. The first and second mating tails 212, 211 extend out of the passageways 10 beyond the mounting surface 18 of the housing 1. A section of each second mating tail 211 extends into the corresponding recess 121 and rests on the supporting plate 12.

Figure 3:
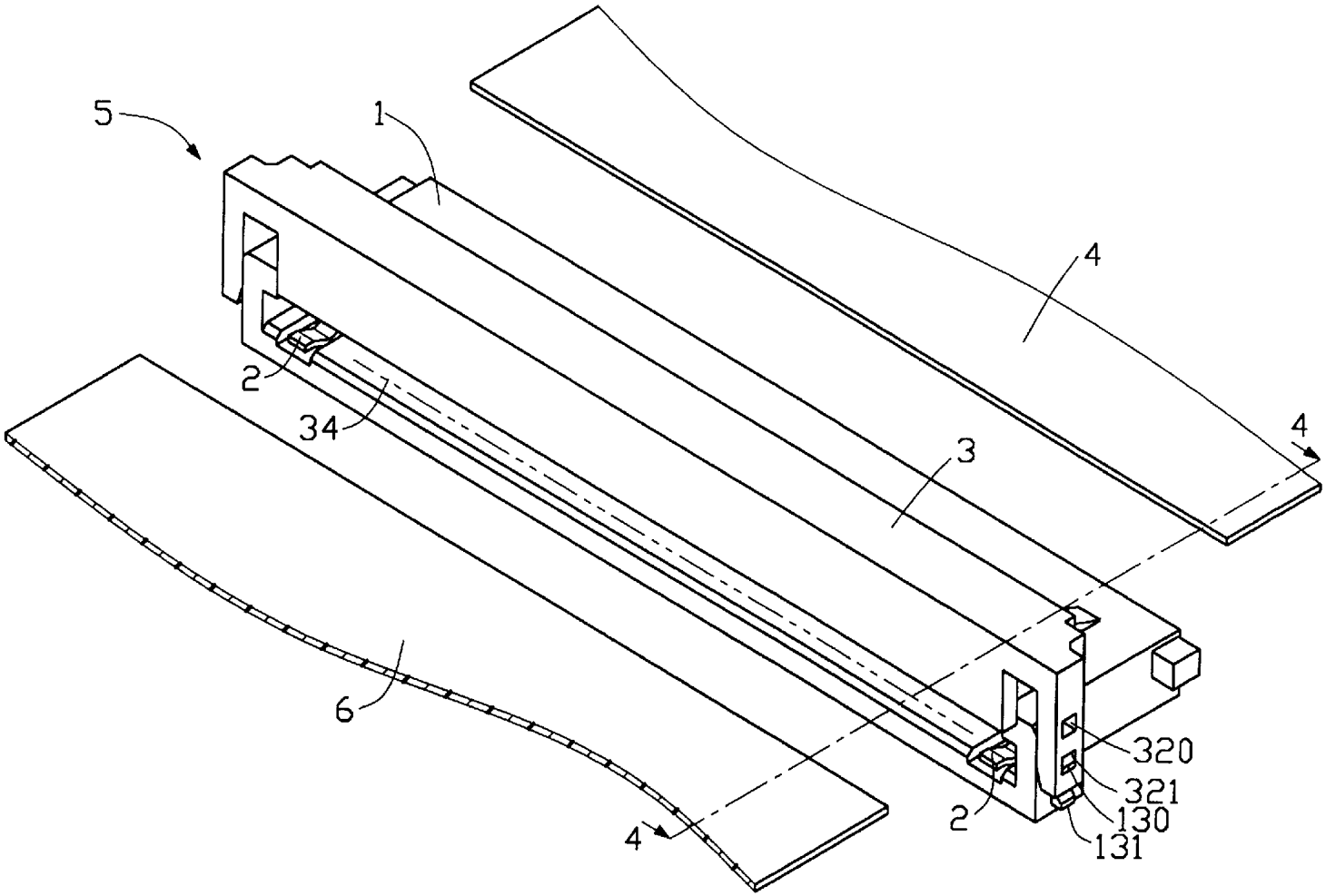
FIG. 3 is an assembled view of FIG. 1 and a pair of flexible cables to be inserted therein.
Figure 4:
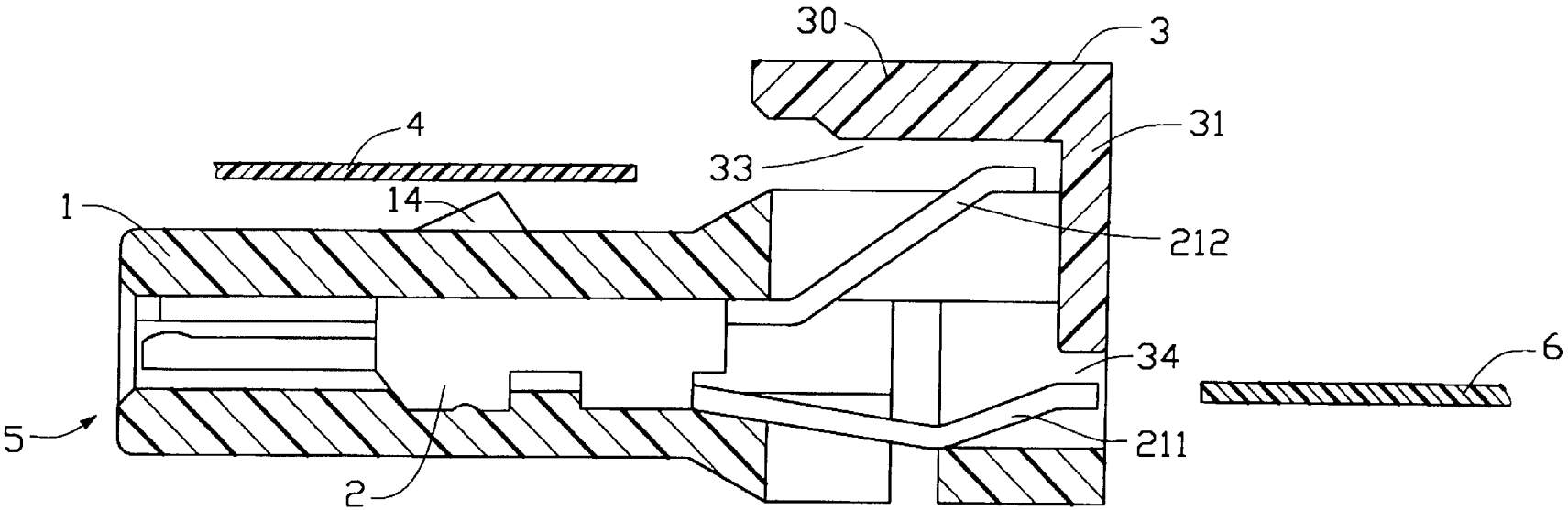
FIG. 4 is a cross-sectional view of FIG. 3 taken along line 4—4.

Referring to FIGS. 3 and 4, in assembly, the stuffer 3 is mounted to the housing 1 with each first rib 130 engaging with the corresponding second hole 321. A first gap 33 is defined between a bottom surface of the body 30 of the stuffer 3 and the first mating tails 212 for receiving an end of a first flexible cable 4. A second gap 34 is defined between a bottom surface of the stop wall 31 of the stuffer 3 and the second mating tails 211 for receiving an end of a second flexible cable 6.

Figure 5:
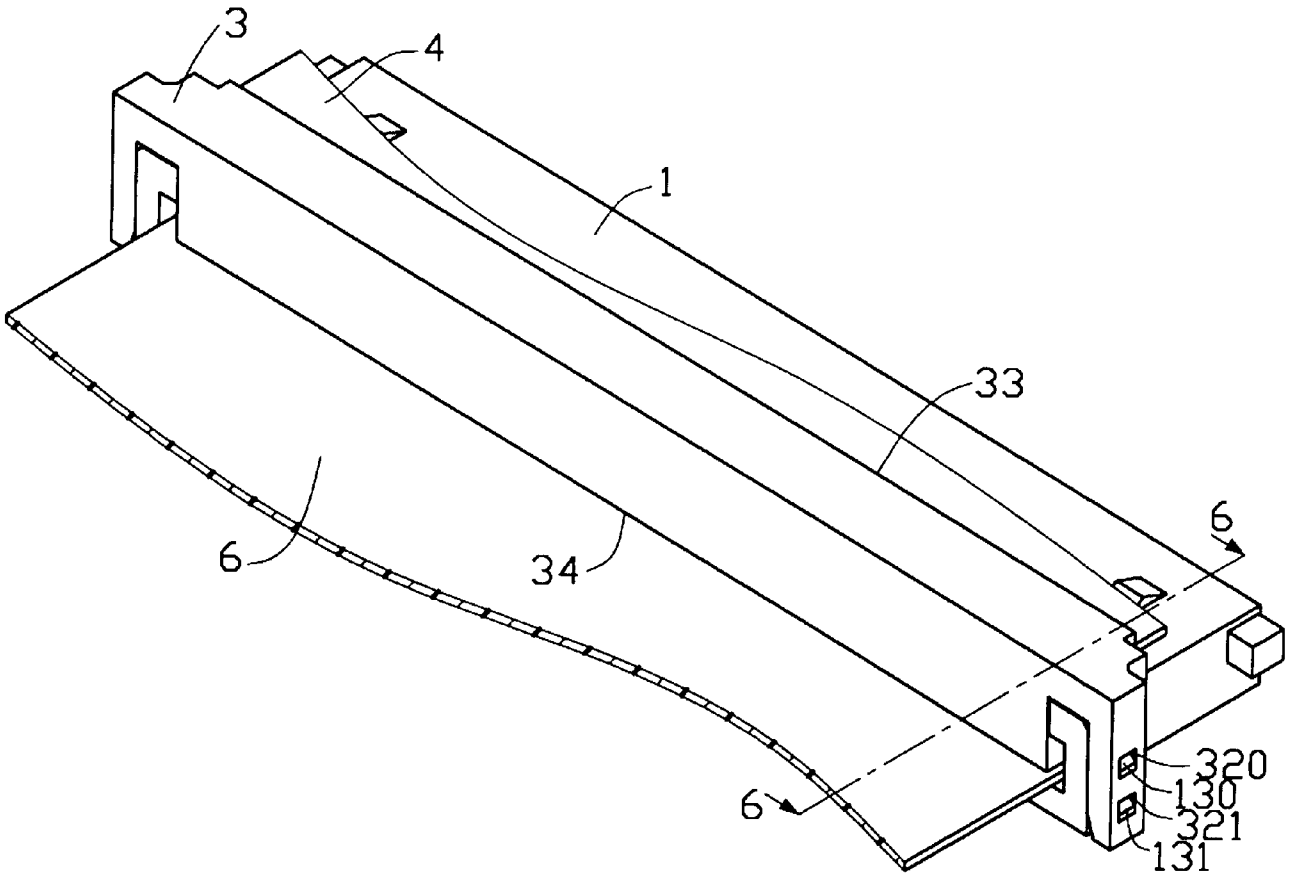
FIG. 5 is similar to FIG. 3 with the flexible cables being inserted therein.
Figure 6:
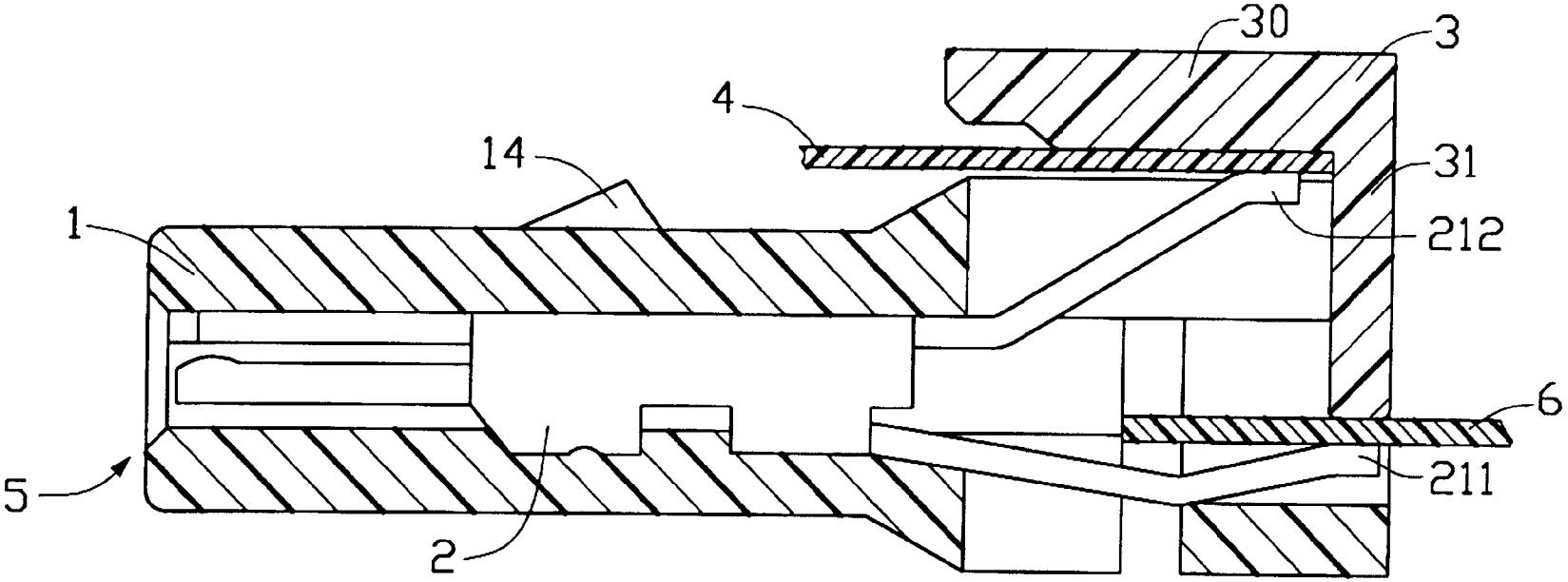
FIG. 6 is a cross-sectional view of FIG. 5 taken along line 6—6.

Also referring to FIGS. 5 and 6, the first flexible cable 4 is inserted into the first gap 33 with the first mating tails 212 contacting corresponding circuit tracks (not shown) thereof. The stop portion 31 of the stuffer 3 is adapted to prevent further movement of the end of the first flexible cable 4 thereby properly positioning the first flexible cable 4. The second flexible cable 6 is inserted into the second gap 34 with the second mating tails 211 contacting corresponding circuit tracks (not shown) of the second flexible cable 6. The stuffer 3 is then downwardly pushed such that each first rib 130 engages with the corresponding first hole 320 and each second rib 131 engages with the corresponding second hole 321. The bottom surface of the body 30 abuts against the first flexible cable 4 to reliably engage with the first mating tails 212. The bottom surface of the stop wall 31 abuts against the second flexible cable 6 to reliably engage with the second mating tails 211.

When the second connector mates with the electrical connector 5, the projections 14 engage in corresponding apertures (not shown) defined in the second connector thereby securing the electrical connector 5 to the second connector.

When the flexible cable 4 is required to be connected to the electrical connector 5 from a direction opposite the predetermined direction, the flexible cable 4 need not be bent. Thus, the flexible cable 4 and conductive wires thereof are unlikely to be damaged. In addition, the electrical connector 5 receiving the two flexible 4, 6 cables promotes efficient use of space and an efficient layout of circuits on a PCB. Furthermore, the manufacture of such an electrical connector 5 is time and cost efficient.

When the assembled connector 5 is required to be transported, the stuffer 3 may be disassembled from the connector 5. Since the stuffer 3 is not pivotally mounted to the housing 1, the stuffer 3 will not be damaged by other parts of the connector 5 or other external objects due to improper vibration. Alternatively, the assembled connector 5 may be transported without disassembling the stuffer 3, since the stuffer 3 can be reliably secured to the housing 1.

Figure 7:
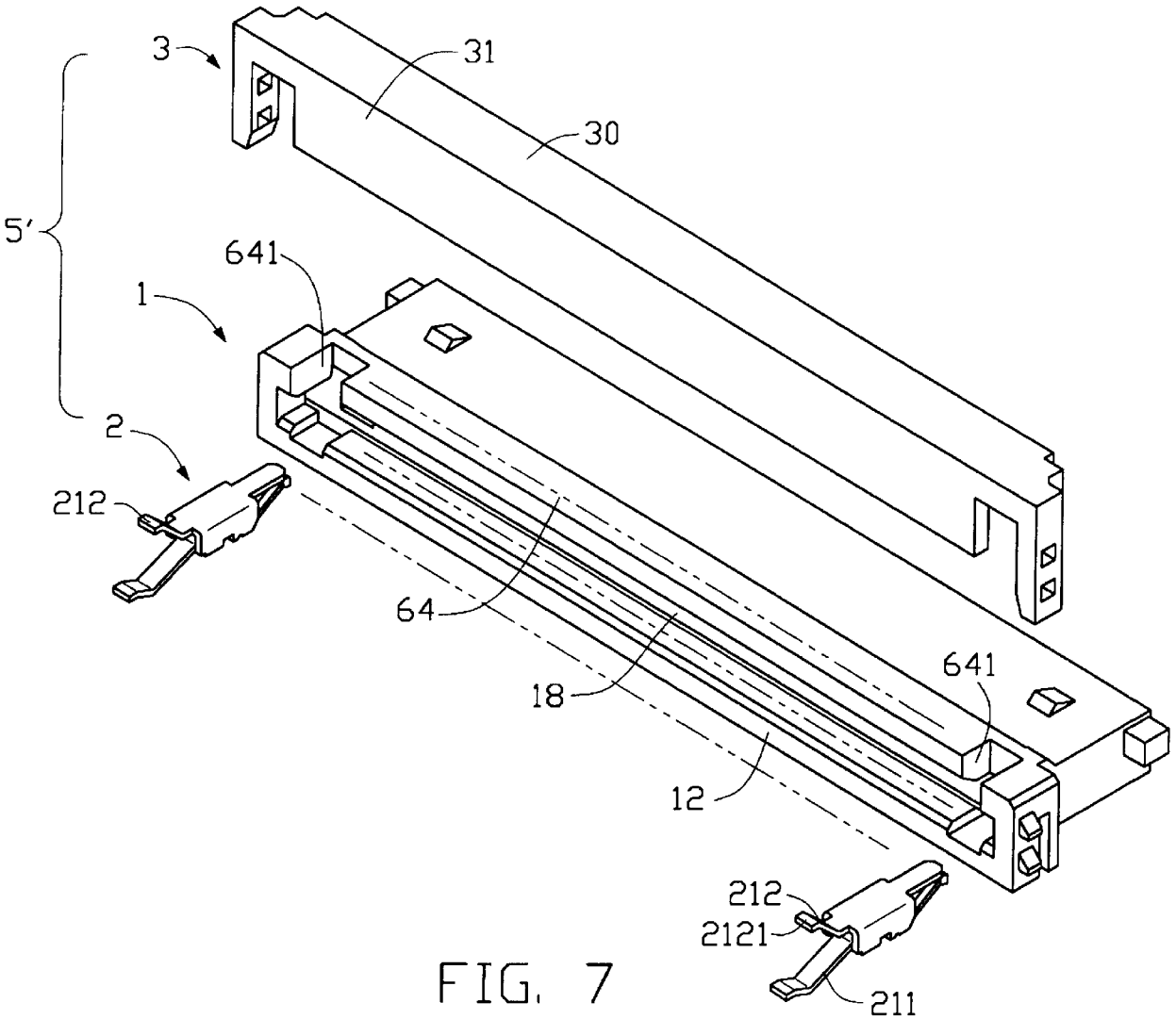
FIG. 7 is an exploded view of an electrical connector of an alternative embodiment of the present invention.

FIG. 7 shows an electrical connector 5' of a second embodiment of the present invention. The differences between the electrical connector 5' of the second embodiment and the electrical connector 5 of the first embodiment reside in a portion of the housing 1. Therefore, like reference numerals used in FIGS. 1–6 have been applied to designate like components of the electrical connector 5'. A retention plate 64 extends from the mounting surface 18 of the housing 1 proximate the top surface thereof. The retention plate 64 defines a plurality of cutouts 641 corresponding to the passageways 10 for extension of the first mating tails 212 therethrough. In assembly, the first flexible cable 4 is inserted into the first gap 33 and reliably rests on the retention plate 64. The bottom surface of the body 30 of the stuffer 3 presses against the first flexible cable 4 on the retention plate 64. Thus, the first flexible cable 4 can be correctly and reliably positioned thereby facilitating engagement between the first flexible cable 4 and the first mating tails 212.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting with a first flexible cable and a second flexible cable, the first and second cable being inserted into the electrical connector in opposite directions, the electrical connector comprising:

an insulative housing defining a plurality of passageways;

a plurality of terminals retained in the passageways, each terminal including a mating end for mating with a mating connector, a first mating tail and a second mating tail; and a stuffer assembled to the housing, a first gap being defined between the stuffer and the first mating tails for receiving the first flexible cable which engages with the first mating tails, a second gap being defined between the stuffer and the second mating tails for receiving the second flexible cable which engages with the second mating tails;

wherein each terminal is unitarily stamped and formed to include a center barrel portion having a bottom wall, a first side wall extending from an edge of the bottom wall, a top wall extending from an edge of the first side wall, and a second side wall extending from an edge of the top wall;

wherein the first mating tail and the second mating tail of each terminal extend from rear edges of the top wall and the bottom wall, respectively;

wherein the first mating tail includes an intermediate portion upwardly extending at an incline and a contact portion horizontally extending from a distal end of the intermediate portion;

wherein the second mating tail includes an intermediate portion downwardly extending at an incline, an interim portion upwardly extending from a distal end of the intermediate portion and a contact portion horizontally extending from a distal end of the interim portion;

wherein the second side wall forms locking barbs along an edge thereof for being interferentially fit in the passageways;

wherein the housing includes a retention member defining a pair of ribs, the retention member including an arm formed at an end of the stuffer forming a pair of holes corresponding to the ribs adapted to engage with the holes of the retention device thereby securing the stuffer to the housing;

wherein the pair of ribs and the pair of holes are vertically aligned;

wherein each rib forms an inclined surface for facilitating engagement between the rib and the corresponding hole;

wherein a supporting plate rearwardly extends from the housing proximate a bottom surface thereof for supporting the second flexible cable;

wherein a plurality of recesses is defined in the supporting plate corresponding to the passageways for receiving the second mating tails;

wherein a retention plate rearwardly extends from the housing proximate a top surface thereof for supporting the first flexible cable;

wherein a plurality of cutouts is defined in the retention plate corresponding to the passageways for extension of the first mating tails therethrough;

wherein the stuffer includes a body for pressing against the first flexible cable and a stop portion for preventing further movement of the first flexible cable thereby properly positioning the first flexible cable, the body of the stuffer further pressing against the second flexible cable;

wherein a pair of projections is formed on a top surface of the housing for engaging with corresponding apertures of a mating second connector thereby securing the electrical connector to the second connector;

wherein an orienting block outwardly projects from each end of the housing.

* * * * *